US005711046A

United States Patent [19]

Potter

[11] Patent Number: 5,711,046

[45] Date of Patent: Jan. 27, 1998

[54] WELL CLEANING APPARATUS

[75] Inventor: Ronald Potter, Arberdeen, United Kingdom

[73] Assignee: Rotary Drilling Supplies of Europe Limited, Aberdeen, Scotland

[21] Appl. No.: 538,824

[22] Filed: Oct. 5, 1995

[30] Foreign Application Priority Data

Apr. 1, 1995 [GB] United Kingdom ..... 9506797

[51] Int. Cl.[6] ..... F21B 37/02; F21B 37/06

[52] U.S. Cl. ..... 15/104.2; 15/104.16; 166/173

[58] Field of Search ..... 15/104.2, 104.16, 15/104.05, 104.061, 104.31, 104, 3.5; 166/170, 171, 173, 176, 177.3, 312, 174, 311

[56] References Cited

U.S. PATENT DOCUMENTS

| | | | |
|---|---|---|---|
| 1,195,308 | 8/1916 | Whidden | 15/104.2 |
| 1,342,618 | 6/1920 | Bashara | 166/173 |
| 2,246,421 | 6/1941 | Tate | 15/104.16 |
| 2,248,742 | 7/1941 | Burnham | 15/104.061 |
| 2,436,934 | 3/1948 | Nielsen et al. | 15/104.2 |
| 2,442,480 | 6/1948 | Anderson | 15/104.2 |
| 2,465,231 | 3/1949 | Hollis | 15/104.2 |
| 2,552,339 | 5/1951 | Moon | 15/104.2 |
| 2,832,420 | 4/1958 | Breukelman | 166/173 |
| 3,047,895 | 8/1962 | Ver Nooy | 15/104.2 |
| 3,466,691 | 9/1969 | Wessel | 15/104.2 |
| 3,824,646 | 7/1974 | Jai | 15/104.2 |
| 3,827,492 | 8/1974 | Hammon et al. | 166/173 |
| 4,016,620 | 4/1977 | Powers | 15/104.061 |
| 4,144,609 | 3/1979 | Dubs | 15/104.2 |
| 4,501,322 | 2/1985 | Martin | 15/104.2 |
| 4,503,578 | 3/1985 | McIntyre | 15/104.2 |
| 4,825,498 | 5/1989 | Rankin | 15/104.061 |
| 5,419,397 | 5/1995 | Reynolds et al. | 166/173 |
| 5,570,742 | 11/1996 | Reynolds et al. | 166/173 |

FOREIGN PATENT DOCUMENTS

| | | |
|---|---|---|
| 623717 | 5/1949 | United Kingdom . |
| 808783 | 2/1959 | United Kingdom . |
| 862750 | 3/1961 | United Kingdom . |
| 2226349 | 6/1990 | United Kingdom . |
| 94/29569 | 12/1994 | WIPO . |

OTHER PUBLICATIONS

Oiltools (Europe) Limited brochure (2 pgs.) for Casing Completion Conditioner (published after present application priority date of Apr. 1, 1995.)

*Primary Examiner*—Gary K. Graham
*Attorney, Agent, or Firm*—Ratner & Prestia

[57] ABSTRACT

An apparatus for cleaning the interior of a well tubing, comprising a body member (10) for insertion into the tubing, and at least one cleaning pad (14) mounted on the body member (10), the or each cleaning pad (14) comprising a body having an inner face engaged with the body member (10) and an outer face provided with protruding bristles (38). The apparatus further comprises protection pads (50) mounted on the body member (10).

12 Claims, 3 Drawing Sheets

WELL CLEANING APPARATUS

This invention relates to apparatus for cleaning the interior of a well tubing or the like preferably, but not exclusively, for cleaning the inside of oil, gas or water well tubulars or casings.

BACKGROUND OF THE INVENTION

Due to the operating conditions and environment, oil, gas and water well tubulars or casings require regular cleaning. Conventionally, cleaning the inner structure of a drill casing or tubing would involve utilising a casing scraper assembly, such as the Best oiltool casing scraper assembly. Such a conventional assembly incorporates steel casing scraper blades that scour the inside of the casing or tubing. Typically, each blade features several raised steel ribs that, once the scraper assembly has been lowered down the tubing or casing required to be cleaned, lie flush with the inner surface of said tubing or casing.

Typically there are six scraper blades per scraper assembly, three upper scraper blades positioned 60° apart around the scraper assembly and three rower scraper blades that are positioned 60° apart and 60° offset, when compared with the upper three scraper blades. Thus this conventional arrangement provides for a 360° cleaning capability of the assembly.

A disadvantage of the conventional scraper blade is that the raised steel rib arrangement is not efficient since it requires considerable drill string movement to clean the specified portion of the inner structure of the tubing or casing, and it rapidly becomes less effective with wear.

Another disadvantage of using conventional steel scraper assemblies is that, if they become dislodged from the scraper assembly apparatus, the cleaning operation must be stopped, the scraper assembly withdrawn and an attempt to retrieve the lost steel scraper must be initiated, which may take a long time.

There are also safety implications if a conventional steel scraper blade becomes dislodged from the scraper assembly apparatus, on the basis that if the assembly apparatus is not stopped quickly, then the steel scraper blade will be free to impede the rotating string.

SUMMARY OF THE INVENTION

A first aspect of the present invention provides apparatus for cleaning the interior of a well tubing comprising a body member for insertion into the tubing, and at least one cleaning pad mounted on the body member, the or each cleaning pad comprising a body having an inner face engaged with the body member and an outer face provided with protruding bristles.

Preferably, a plurality of cleaning pads are circumferentially spaced around the body member. Typically, there is an upper row of three cleaning pads centred at 120° intervals, and a lower row of cleaning pads centred at 120° intervals and circumferentially offset with respect to the upper row.

The bristles may be of nylon. Alternatively, the bristles may be of wire, such as flame hardened steel or copper.

In a particularly preferred feature of the invention, the cleaning pad is constructed to be drillable; that is to be capable of being readily cut by a rock drill bit.

The body may be manufactured from a compressible material.

The inner portion of the body may be arranged so that the body is compressible, the inner portion of the body preferably being arranged in a honeycomb structure to aid compressibility.

The body may suitably be of a resin fibre compound, preferably a polyurethane fibre compound.

The bristles may be mounted in a backing secured to the body, suitably by adhesive. The backing may be fabric into which the bristles are sewn or woven, or may be an elastomeric soft compound rubber material.

Alternatively, the body may typically be manufactured from a malleable metal such as aluminium.

Typically, the brush pads may be interchanged to different grades of bristle, to suit all types of cleaning environment.

A second aspect of the present invention provides a protection device for use with the apparatus of the first aspect of the present invention, the protection device comprising at least one protection pad, the or each protection pad being mounted on the body member and being constructed from a softer material than the well tubing.

Preferably, a plurality of protection pads are circumferentially spaced around the body member. Typically there is an upper row of protection pads and a lower row of protection pads. Preferably the upper row of protection pads is above the uppermost row of cleaning pads and the lower row of protection pads is below the lowermost row of cleaning pads.

The protection pads may be permanently secured to the body member.

Alternatively the protection pads may be removable from the body member.

BRIEF DESCRIPTION OF THE DRAWINGS

Embodiments of the invention will now be described, by way of example, with reference to the accompanying drawings, in which.

DESCRIPTION OF PREFERRED EMBODIMENTS

Figure 1:
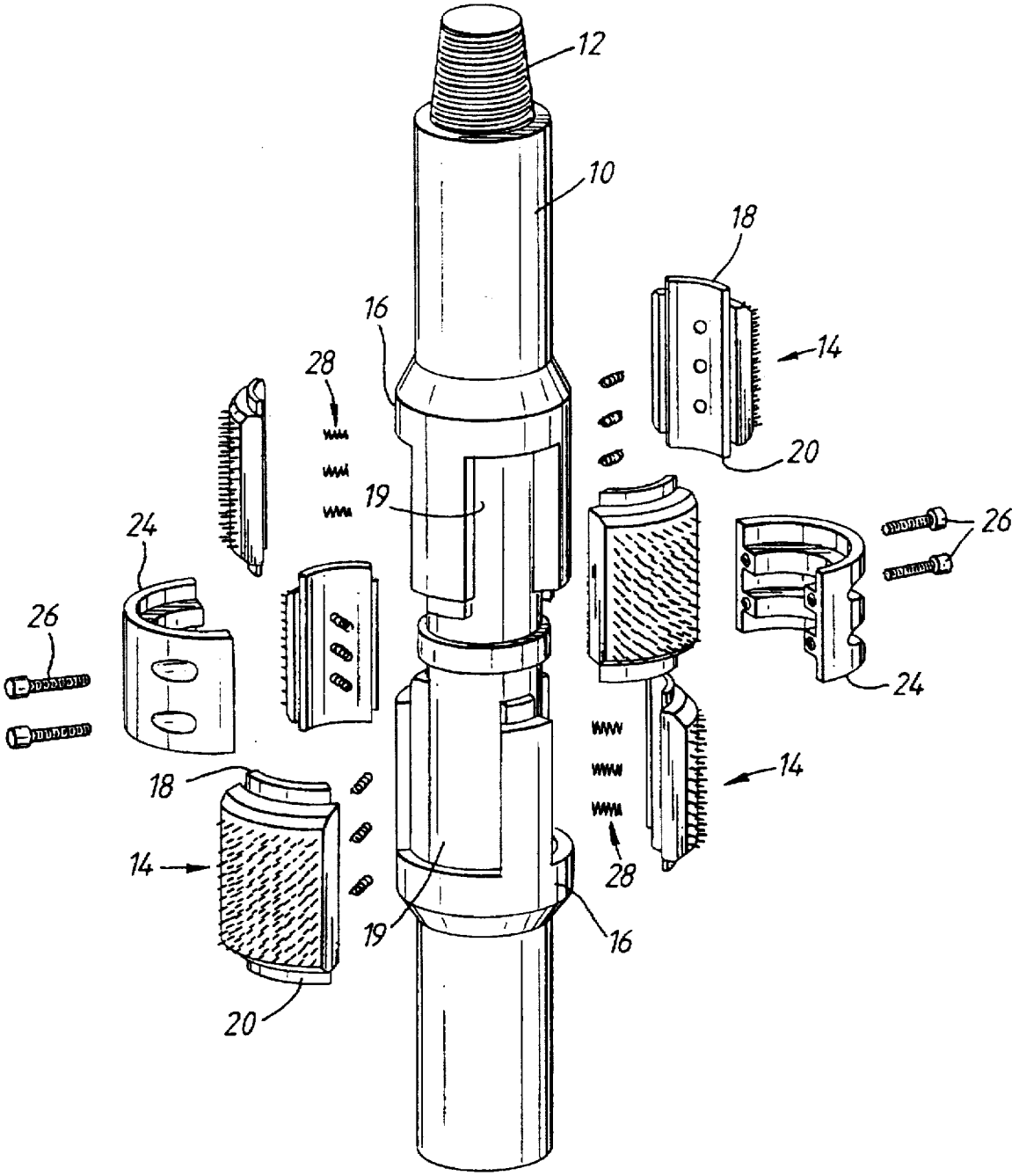
FIG. 1 is an exploded perspective view of a first example of well cleaning apparatus in accordance with the present invention.
Figure 2:
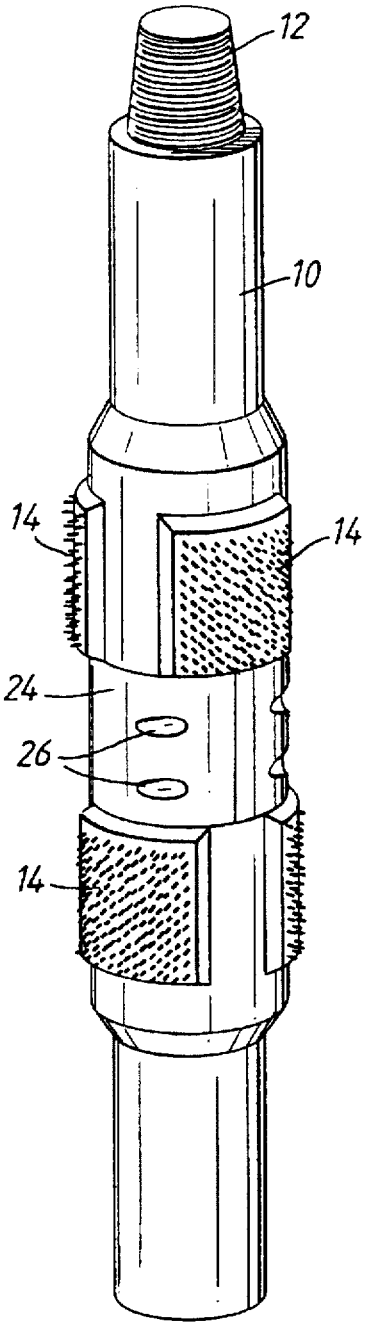
FIG. 2 is a perspective view showing the apparatus of FIG. 1 in assembled condition.

Referring to FIGS. 1 and 2, a well cleaning apparatus comprises a mandrel 10 for inclusion in a drill string by means of a pin connector 12 and a box connector (not seen in the drawings) at the lower end.

The mandrel 10 carries six cleaning pads generally designated at 14. The cleaning pads 14 are arranged in an upper row of three equally spaced around the circumference of the apparatus and a lower row of three equispaced pads offset from those of the upper row. The mandrel 10 has projecting formations providing upper and lower collars 16 and slots 19. Each cleaning pad 14 (see also FIGS. 3 and 4) is formed with an upper lip 18, a lower lip 20, and angled side faces 22. Each pad 14 is secured in position on the mandrel by engaging one of the lips 18 and 20 underneath one of the collars 16 with the side faces 22 engaged in the slots 19. The inner ends of the pads 14 are then held in position by a two part collar assembly 24 secured together by screws 26. Each cleaning pad 14 is biased outwardly by a series of coil springs 28 each engaging in a corresponding bore 30 in the rear of the cleaning pad 14.

Figure 3:
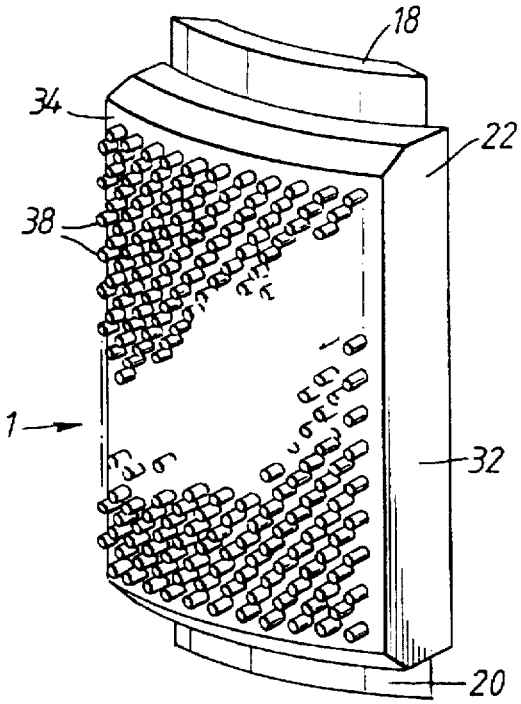
FIG. 3 is a front perspective view of a cleaning pad of the apparatus.
Figure 4:
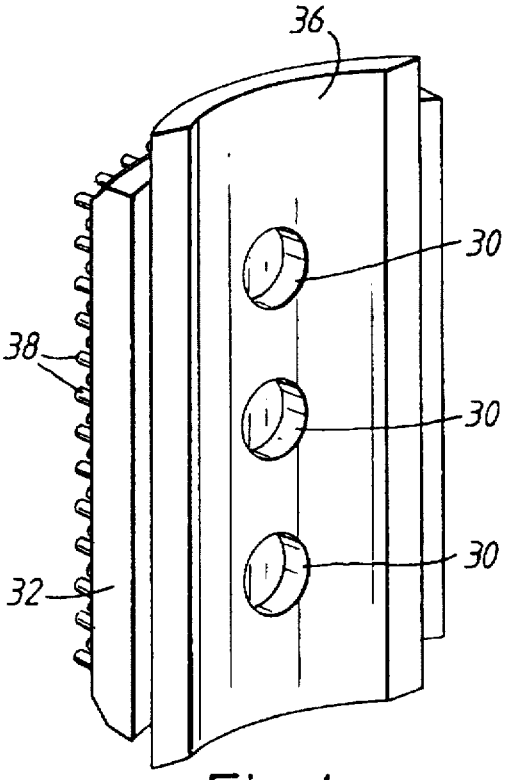
FIG. 4 is a rear perspective view of the cleaning pad.

Referring particularly to FIGS. 3 and 4, each cleaning pad 14 comprises a body 32 having an arcuate front face 34 and an arcuate rear face 36. Bristles 38 project from the front face 34 to provide, in use, a scrubbing action on the interior of the tubular being cleaned. In a preferred form, the bristles 38 are formed from flame hardened steel wire or copper wire and may suitably be ⅛" diameter set at ⅛" spacings.

The body 32 is suitably a unitary moulding encapsulating a portion of each of the bristles 38 and is preferably moulded from a polyurethane fibre compound.

In order to assist manufacture, the bristles 38 may be set in a sheet of textile or rubber material before being incorporated in the body 32.

The cleaning pads 14 may readily be interchanged to provide a suitable cleaning effect from any particular application. For example the pads 14 may be interchanged for pads having smaller diameter wire bristles or nylon bristles.

Figure 6:
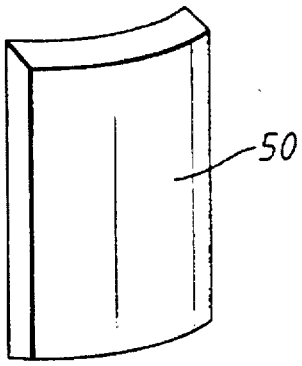
FIG. 6 is a perspective view of a protection pad for use with the apparatus shown in FIG. 5.
Figure 7:
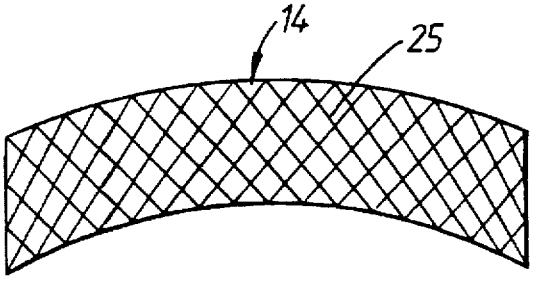
FIG. 7 is a sectional view of a cleaning pad of the apparatus.

The cleaning pads 14 may be constructed from a compressible material and further may have a honeycomb-like centre 25, to aid compressibility, as can be seen in FIG. 6.

In the event that one or more of the cleaning pads 14 becomes dislodged from the mandrel 10, the nature of its construction is such that it is readily drilled through by a drill bit or other implement commonly used in a well tubular, since the polyurethane body is relatively easily drilled away leaving relatively small pieces of wire which can be handled in a manner similar to drill chippings.

The well tubing may change direction by a relatively high degree, thus requiring the drillstring to navigate this change in direction if, for instance, the drillstring is being run in or pulled out of the well tubing.

Figure 5:
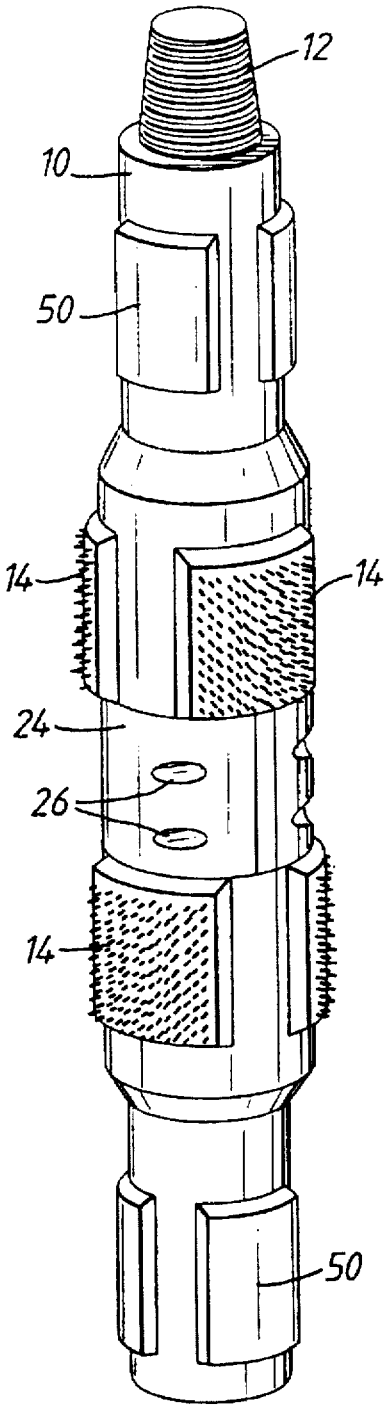
FIG. 5 is a perspective of a second example of well cleaning apparatus.

FIG. 5 shows a second example of well cleaning apparatus with protection pads 50 mounted on the mandrel 10 and arranged in an upper row and a lower row. The upper row of protection pads 50 are located above the upper row of cleaning pads 14, and the lower row of protection pads 50 are located below the lower row of cleaning pads 14. The protection pads 50 project outward from the mandrel 10 by a sufficient length so that if the mandrel 10 navigates a change in direction of the well tubing, the protection pads 50 are substantially the point of contact between the mandrel 10 and the well tubing. As the protection pads 50 are constructed from a softer material than the well tubing, the protection pads 50 are sacrificed in order to protect both the mandrel 10, the cleaning pads 14 and the well tubing. An individual protection pad 50 is shown in FIG. 6.

Modifications may be made to the aforegoing within the scope of the present invention.

I claim:

1. An apparatus for cleaning an interior bore of a tubular member, said apparatus comprising a body member defining an outer circumference for insertion into the tubular member, a plurality of cleaning pads arranged in an upper row and a lower row, said lower row circumferentially offset with respect to said upper row, each said cleaning pad comprising a body having an inner face engaged with the body member and an outer opposing face provided with protruding bristles and said upper row of pads each being provided with a first edge in engagement with a first recess in the body member, said lower row of pads each being provided with a first edge in engagement with a second recess in the body member, and a second edge of each said pad in engagement with a removable retaining device retaining the cleaning pads on the body member, such that removal of the retaining device permits removal of the cleaning pads from the body member.

2. Apparatus according to claim 1 wherein the upper and lower rows of cleaning pads are centered at equal intervals.

3. Apparatus according to claim 2 wherein, there is in said upper row three cleaning pads centred at 120° intervals, and in said lower row there are three cleaning pads centred at 120° intervals.

4. Apparatus according to claim 3, wherein a plurality of protection pads are circumferentially spaced around, and mounted on the body member to form an upper row of protection pads and a lower row of protection pads, where the upper row of protection pads are located above the upper row of cleaning pads and the lower row of protection pads are located below the lower row of cleaning pads,. and the protection pads are manufactured from a soft material.

5. Apparatus according to claim 1 wherein, the bristles are nylon bristles.

6. Apparatus according to claim 1 wherein, the bristles are hardened metal wire bristles.

7. Apparatus according to claim 1 wherein, the cleaning pad body is constructed from a drillable material.

8. Apparatus according to claim 7 wherein, the cleaning pad body is constructed from a resin fibre compound.

9. Apparatus according to claim 7 wherein, the cleaning pad body is manufactured from a malleable metal.

10. Apparatus according to claim 1, wherein the cleaning pad body is compressible.

11. Apparatus according to claim 1, further comprising at least one protection pad mounted on the body member, where the protection pad is manufactured from a soft material.

12. Apparatus according to claim 11, wherein a plurality of protection pads are circumferentially spaced around the body member.

* * * * *

UNITED STATES PATENT AND TRADEMARK OFFICE

CERTIFICATE OF CORRECTION

PATENT NO. : 5,711,046

DATED : January 27, 1998

INVENTOR(S) : Ronald Potter

It is certified that error appears in the above-identified patent and that said Letters Patent is hereby corrected as shown below:

On the title page, item [75] Inventor: should read -- Ronald Potter, Aberdeen, United Kingdom --

Column 4, line 32, should read -- are located below the lower row of cleaning pads, and the --

Signed and Sealed this

Twenty-sixth Day of May, 1998

*Attest:*

*Attesting Officer*

BRUCE LEHMAN

*Commissioner of Patents and Trademarks*